US009539624B2

(12) United States Patent
Whinnem et al.

(10) Patent No.: US 9,539,624 B2
(45) Date of Patent: Jan. 10, 2017

(54) HOLE CLEANING APPARATUS AND METHOD

(75) Inventors: Eric Whinnem, Whittier, CA (US); Gary A. Lipczynski, Garden Grove, CA (US); Wesley E. Holleman, Long Beach, CA (US); Daniel W. Barnett, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 1294 days.

(21) Appl. No.: 13/438,326

(22) Filed: Apr. 3, 2012

(65) Prior Publication Data

US 2013/0255723 A1 Oct. 3, 2013

(51) Int. Cl.

| | |
|---|---|
| ***B08B 5/02*** | (2006.01) |
| ***B08B 9/00*** | (2006.01) |
| ***B08B 1/04*** | (2006.01) |
| ***B08B 15/04*** | (2006.01) |
| ***A46B 13/02*** | (2006.01) |
| ***A46B 15/00*** | (2006.01) |

(52) U.S. Cl.

CPC ..... *B08B 9/00* (2013.01); *A46B 13/02* (2013.01); *A46B 15/0053* (2013.01); *B08B 1/04* (2013.01); *B08B 15/04* (2013.01); *A46B 2200/3013* (2013.01)

(58) Field of Classification Search

None

See application file for complete search history.

(56) References Cited

U.S. PATENT DOCUMENTS

| | | | |
|---|---|---|---|
| 6,813,810 | B2 | 11/2004 | Beynon |
| 7,958,587 | B1 | 6/2011 | Hansen |

FOREIGN PATENT DOCUMENTS

| | | | |
|---|---|---|---|
| CN | 202090871 | * | 12/2011 |
| DE | 19757424 | | 6/1999 |
| DE | 102007004158 | * | 7/2008 |
| EP | 2123369 | | 11/2009 |
| JP | 08-011016 | * | 1/1996 |
| WO | 9520440 | | 8/1995 |

OTHER PUBLICATIONS

Machine translation of JP 08-011016 by Mukai et al., published Jan. 16, 1996.*

* cited by examiner

*Primary Examiner* — Michael Kornakov
*Assistant Examiner* — Ryan Coleman
(74) *Attorney, Agent, or Firm* — Patterson + Sheridan LLP

(57) ABSTRACT

A hole cleaning apparatus includes a member, a brush, and a vacuum source. The brush rotates around a longitudinal axis of the member, or translates in a direction which is substantially parallel to the longitudinal axis of the member. The vacuum source provides vacuum suction within the member.

19 Claims, 7 Drawing Sheets

HOLE CLEANING APPARATUS AND METHOD

FIELD OF THE DISCLOSURE

The disclosure relates to hole cleaning apparatus, and to methods of their use, for cleaning a hole of a surface.

BACKGROUND OF THE DISCLOSURE

After drilling a hole in a surface, the hole often needs to be cleaned in preparation for measurement, fastener installation, or other processes. During manufacture and assembly of an aircraft, thousands of holes may be drilled and cleaned. It is important to remove the particles from the hole as the particles may become a source of sparking when electrical charges are passed through a fastener installed in the hole. The particles may affect fit-up of the fastener and faying surfaces. The particles may also mix with sealants being used on the fastener and joint to cause a paste and create leak paths.

The existing hole cleaning apparatus have a difficult time effectively cleaning the holes to a consistently high standard without time consuming repetitive physical work on behalf of the mechanic. In one such existing hole cleaning process, the mechanic first inserts a bottle brush into the hole to begin cleaning the hole. The bottle brush needs to be constantly cleaned with a rag. Subsequently, the mechanic wraps multiple strips of rags around his finger and pushes his finger through the hole. Next, the mechanic wraps rags soaked in alcohol around his finger and twist his finger inside the hole, constantly wiping the inside of the hole until all particles are removed from the inside and outside surfaces of the hole. This process is time consuming, tedious with physically repetitive motions, and may lead to undesired results.

There is a need for a hole cleaning apparatus and method of use to clean a hole of a surface while avoiding one or more of the issues encountered by one or more of the current hole cleaning apparatus and methods of use.

SUMMARY OF THE DISCLOSURE

In one embodiment, a hole cleaning apparatus is disclosed. The hole cleaning apparatus comprises a member, a brush, and a vacuum source. The brush rotates around a longitudinal axis of the member, or translates in a direction which is substantially parallel to the longitudinal axis of the member. The vacuum source provides vacuum suction within the member.

In another embodiment, a hole cleaning apparatus is disclosed. The hole cleaning apparatus comprises a member, a brush, a telescoping or bellowing member, and a vacuum source. The telescoping or bellowing member is extendable or retractable. The vacuum source provides vacuum suction within the member.

In an additional embodiment, a method is disclosed of cleaning a hole of a surface. In one step, a brush of the hole cleaning apparatus brushes the hole of the surface by rotating or translating around or in a direction substantially parallel to a longitudinal axis of a member of the hole cleaning apparatus. In an additional step, particles are collected from the hole of the surface into the member of the hole cleaning apparatus.

These and other features, aspects and advantages of the disclosure will become better understood with reference to the following drawings, description and claims.

DETAILED DESCRIPTION OF THE DISCLOSURE

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
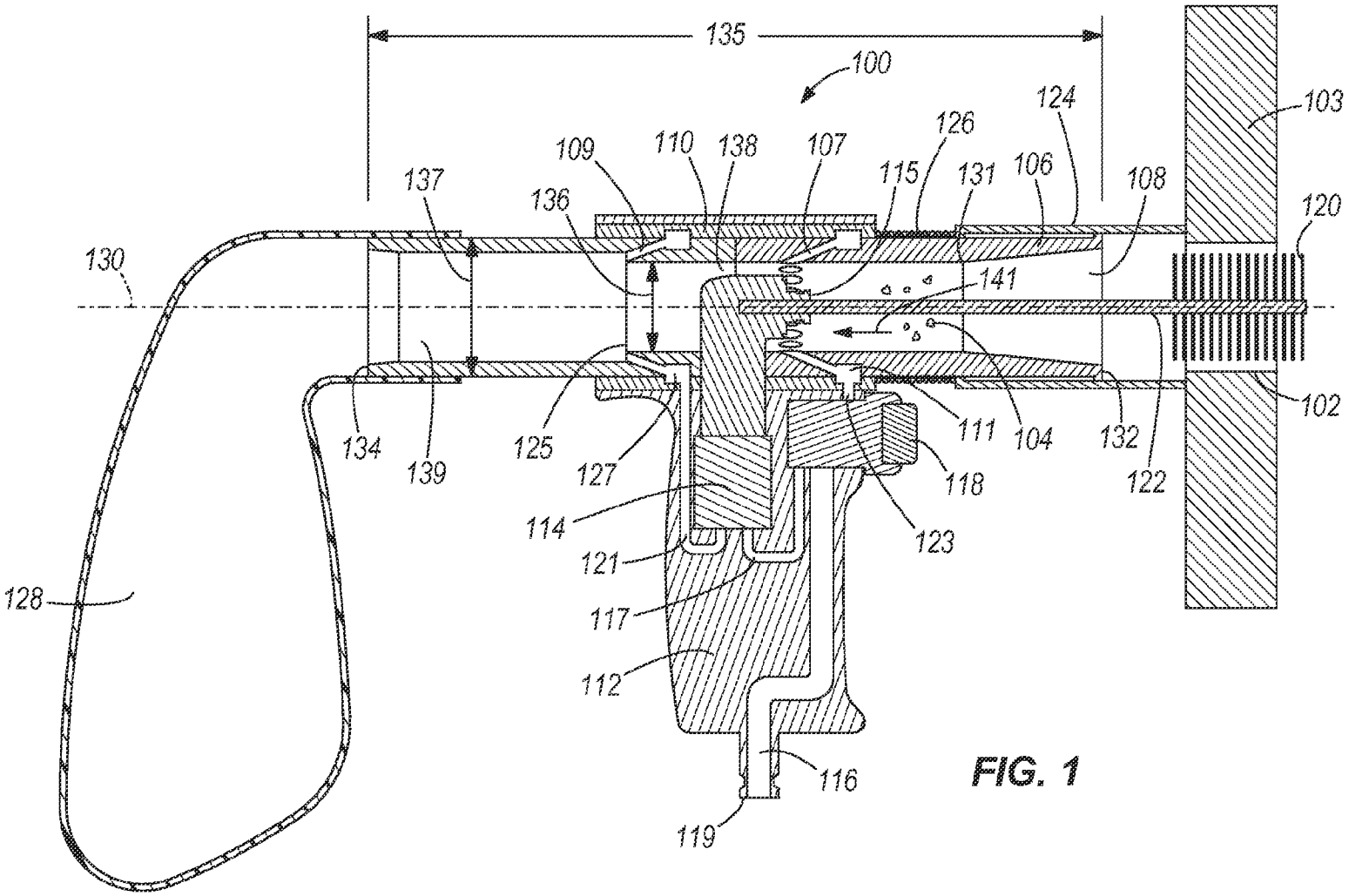
FIG. 1 illustrates a cross-section view of one embodiment of a hand-held hole cleaning apparatus with a brush extended from the hand-held hole cleaning apparatus into a hole of a surface.

FIG. 1 illustrates a cross-section view of one embodiment of a hand-held hole cleaning apparatus 100 with a brush 120 extended from the hand-held hole cleaning apparatus 100 into a hole 102 of a surface 103. The hand-held hole cleaning apparatus 100 may be used to clean the hole 102 of the surface 103 by removing particles 104 from the hole 102. The particles 104 may comprise pieces of the surface 103 resulting from drilling of the hole 102. The surface 103 may comprise a composite surface such as a composite stacked surface, a surface made out of any type of metal or other type of material, an aircraft structure, or another type of structure. The hole cleaning apparatus 100 comprises: a member 106 having an opening 108 extending along a longitudinal axis 130 of the member 106, and primary vacuum generator orifices 107 and secondary vacuum generator orifices 109 extending through the member 106 into the opening 108; a vacuum generator manifold 110 having a primary annular plenum chamber 111 and a secondary annular plenum chamber 127; a handle 112; a motor 114; a shop supply airway 116; a motor supply airway 117; a motor exhaust airway 121; a primary vacuum generator supply airway 123; a trigger 118; a brush 120; a rod 122; a telescoping member 124; a biasing member 126; and a bag 128.

The member 106 comprises a tube having a cylinder shape. In other embodiments, the member 106 may comprise a varying type of member having a varying shape. The opening 108 extends within the member 106, along a longitudinal axis 130 of the member 106, between first and second opposed ends 132 and 134 of the member 106. The length 135 of the member 106 is 8 inches. In one embodiment, the length 135 of the member 106 ranges between 1 to 24 inches. In other embodiments, the length 135 of the member 106 may vary. The outer diameter 137 of the member 106 is 1.5 inches. In one embodiment, the outer diameter 137 of the member 106 ranges between 0.5 to 10 inches. In other embodiments, the outer diameter 137 of the member 106 may vary over its length. The member 106 may be made of steel, metal, composite, plastic, or another material.

The opening 108 with the member 106 comprises a varying size (cross-section/diameter) 136 to assist in the generation of vacuum pressure in the member 106 and smooth the flow of air through the member 106. The opening 108 is flared out at the first opposed end 132 of the member 106 to smooth the flow of air entering the member 106. The opening 108 has a constant diameter from a point 131 to the secondary vacuum generator orifices 109. In one embodiment, the opening 108 is 1.25 inches at the first opposed end 132 of the member 106, and is 1 inch at an intermediate portion 138 of the member 106. In other embodiments, the opening 108 ranges between 0.25 to 10 inches at both the first opposed end 132 of the member 106, and at the intermediate portion 138 of the member 106. In still other embodiments, the diameter of the opening 108 may vary in size over the member 106. The opening 108 is larger at the second opposed end 134 of the member 106 than at the intermediate portion 138 of the member 106 to accommodate the extra volume of air introduced by the air motor exhaust airway 121 to assist in the production of vacuum suction 141 in the member 106. The opening 108 is flared out at the second opposed end 134 of the member 106 to smooth the flow of air exiting the member 106. In one embodiment, the opening 108 is 1.1 inches at an exit portion 139, and is 1.25 inches at the second opposed end 134 of the member 106. In other embodiments, the opening 108 at both the exit portion 139 and at the second opposed end 134 of the member 106 ranges between 0.25 to 10 inches. In still other embodiments, the opening 108 of the member 106 may further vary in size.

The member 106 has a set of primary vacuum generator orifices 107 arrayed radially with respect to the longitudinal axis 130 of the member 106 which are aligned substantially parallel to the longitudinal axis 130. For purposes of this entire disclosure, the term 'substantially parallel' means precisely parallel to or at an angle deviating from being precisely parallel to of up to 15 degrees. These primary vacuum generator orifices 107 are positioned so that they extend through the inner surface of the intermediate portion 138 of the member 106 at approximately its center. In other embodiments the primary vacuum generator orifices 107 extend through the inner surface of the intermediate portion 138 of the member 106 at varying positions. In still other embodiments the primary vacuum generator orifices 107 vary in position, shape, cross section and arrangement. The member 106 has a set of secondary vacuum generator orifices 109 arrayed radially with respect to the longitudinal axis 130 and aligned substantially parallel to the longitudinal axis 130. These secondary vacuum generator orifices 109 are positioned so that they extend through the inner surface of the exit portion 139 of the member 106 at its inner end 125. In other embodiments the secondary vacuum generator orifices 109 extend through the inner surface of the exit portion 138 of the member 106 at varying positions. In still other embodiments the secondary vacuum generator orifices 109 vary in position, shape, cross section and arrangement.

The vacuum generator manifold 110 is fixedly attached around the member 106. The vacuum generator manifold 110 comprises a cylinder. In other embodiments, the shape of the vacuum generator manifold 110 may vary. The vacuum generator manifold 110 may be made of a metal, composite, plastic, or another material. The vacuum generator manifold 110 contains the primary annular plenum chambers 111 which route the compressed air from the primary vacuum generator supply airway 123 to the primary vacuum generator orifices 107 and into the opening 108 of the member 106. The vacuum generator manifold 110 contains the secondary annular plenum chambers 127 which route the compressed air from the motor exhaust airway 121 to the secondary vacuum generator orifices 109 and into the opening 108 of the member 106. The handle 112 is fixedly attached to and around the vacuum generator manifold 110 and extends laterally from the member 106 and vacuum generator manifold 110. The handle 112 comprises a handgrip and allows a user to hold the hole cleaning apparatus 100 during cleaning of the hole 102. The handle 112 may be made of a metal, composite, plastic, or another type of material.

The motor 114 is fixedly attached within the handle 112 and extends from the handle 112, through the vacuum generator manifold 110, into the intermediate portion 138 of the member 106. The brush 120 is moveable relative to the member 106 due to the motor 114 which is connected to the brush 120 with the rod 122. In other embodiments, the brush 120 may be manually operated by a user. The motor 114 comprises a right-angled air motor for both rotating the brush 120 and assisting in the generation of vacuum suction within the opening 108 of the member 106. Shop supply airway 116 extends from an external source 119 supplying shop air, through the handle 112, to the trigger 118. The motor supply airway 117 extends from the trigger 118 to the air motor 114 supplying the motor with compressed air when the trigger 118 is placed in the on-position. The motor exhaust airway 121 extends from the exhaust port of the motor 114 to the secondary annular plenum chamber 127. The primary vacuum generator supply airway 123 extends from the trigger 118 to the primary annular plenum chamber 111. The airways 116, 117, 121, and 123 may comprise any number of openings, members, or tubes. The motor 114 consumes approximately 4 cubic feet per minute (CFM) of 90 pounds per square inch (PSI) of compressed air. In other embodiments, the motor 114 may comprise varying types of motors of differing capacities. The total air usage of the hole cleaning apparatus 100 does not exceed 30 CFM of shop air at 90 PSI. In other embodiments, the total air usage of the hole cleaning apparatus 100 may vary in capacity.

The rod 122 is made of a metal, composite, plastic, or another type of material. The rod 122 is attached to a rotating portion 115 of the motor 114 and the brush 120. The rotating portion 115 of the motor 114 comprises a rotating drill chuck, connected to the rod 122, which is powered by the motor 114 to rotate the rod 122 and the attached brush 120 around the longitudinal axis 130 of the member 106. The brush 120 is made of Nylon and extends around the rod 122. In other embodiments, the brush 120 may be made of Cotton, Polytetrafluoroethylene (PTFE), or other types of materials. The brush 120 is disposed within the telescoping member 124. In other embodiments, the motor 114 may translate the rod 122 and the attached brush 120 back and forth in a direction substantially parallel to the longitudinal axis 130 of the member 106. In still other embodiments, the motor 114 may move the rod 122 and the attached brush 120 in varying directions.

Figure 2:
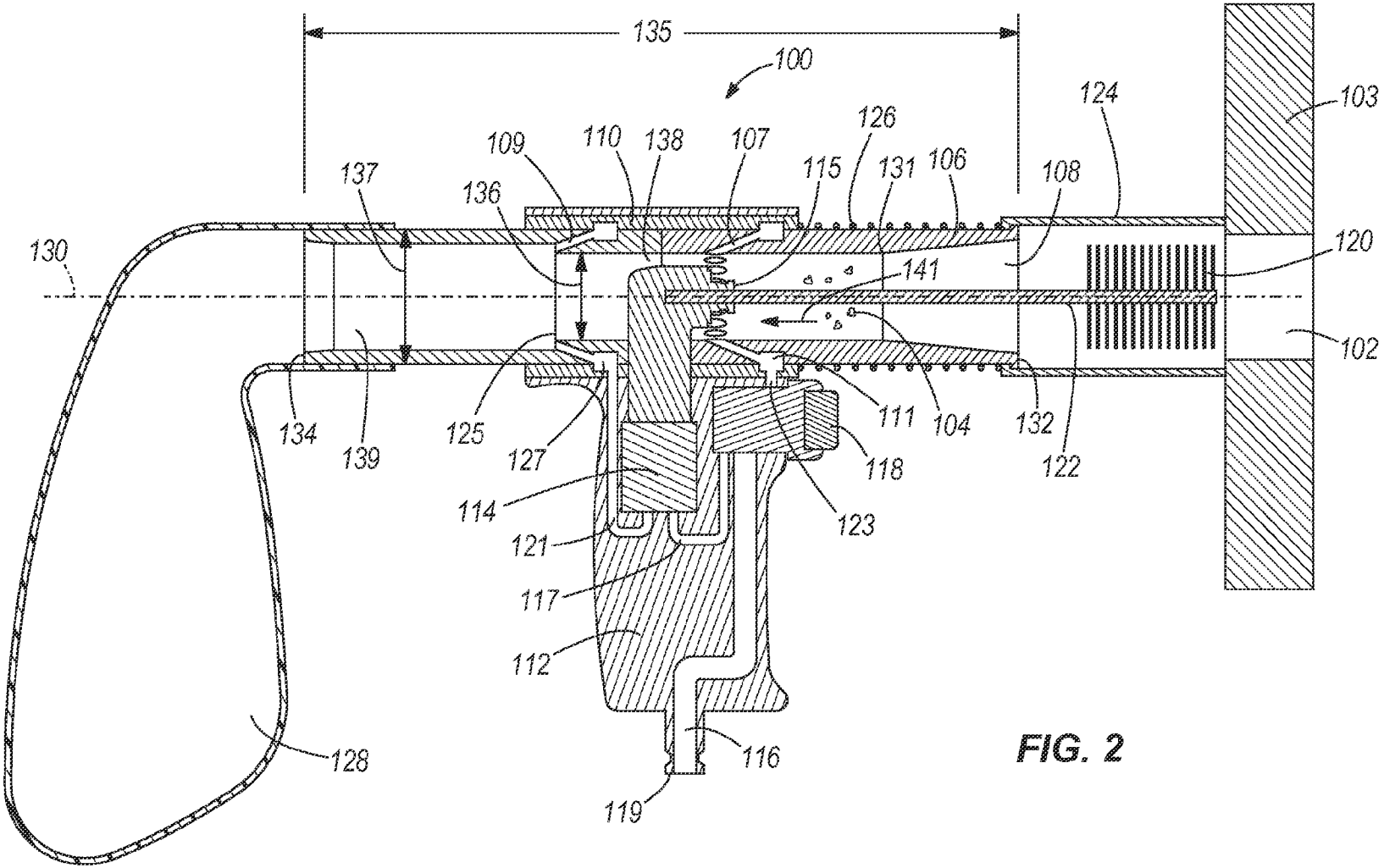
FIG. 2 illustrates a cross-section view of the hand-held hole cleaning apparatus of FIG. 1 with the brush retracted within a telescoping member.

The telescoping member 124 comprises a cylinder. The telescoping member 124 may be made of a metal, composite, plastic, or another type of material. In other embodiments, the telescoping member 124 may vary in shape or material. The telescoping member 124 is moveably attached to the first opposed end 132 of the member 106, and is extendable away from and retractable towards the member 106. The biasing member 126 is attached between the member 106, the vacuum generator manifold 110, or the handle 112 and the telescoping member 124 and biases the telescoping member 124 away from the member 106 towards the hole 102 to assist in creating a vacuum seal of the hole 102. The biasing member 126 may comprise a spring or another type of biasing member. FIG. 2 illustrates a cross-section view of the hand-held hole cleaning apparatus 100 of FIG. 1 with the brush 120 retracted within the telescoping member 124. In use, as shown in FIG. 2, the user uses the handle 112 to abut the telescoping member 124 against or around the hole 102 while the telescoping member 124 is extended away from the member 106 with the brush 120 disposed within the telescoping member 124 outside of the hole 102. As shown in FIG. 1, the user then pushes the handle 112 towards the hole 102 to override the biasing member 126 to retract the telescoping member 124 towards the member 106 to push the brush 120 outside of the telescoping member 124 into the hole 102.

In another embodiment, the member 106 itself may comprise the telescoping member which may be moveably disposed relative to the handle 112 or another portion of the hole cleaning apparatus 100 and which may be biased towards the handle 112 using a biasing member 126 so that when the user pushes the handle 112 towards the hole 102 to override the biasing member 126 the member 106 itself may retract towards the handle 112 to push the brush 120 outside of the member 106 into the hole 102.

When the trigger 118, moveably attached to the handle 112, is moved to an on-position by a user the compressed air in the airway 116 flows to the primary vacuum generator supply airway 123 and to the motor supply airway 117. When the primary vacuum generator supply airway 123 begins to flow with compressed air the primary annular plenum chamber 111 becomes filled with compressed air and the primary vacuum generator orifices 107 begin to flow with compressed air creating a venturi effect and generating vacuum suction within the opening 108 of the member 106. When the motor supply airway 117 begins to flow with compressed air, the motor 114 is powered on, thereby rotating the rod 122 and the attached brush 120 and also creating a flow of compressed air in the motor exhaust airway 121. When the motor exhaust airway 121 begins to flow with compressed air, the secondary annular plenum chamber 127 becomes filled with compressed air and the secondary vacuum generator orifices 109 begin to flow with compressed air creating a venturi effect and assisting in the generation of vacuum suction within the opening 108 of the member 106. When the motor 114 is powered on, the rotating portion 115 (which may comprise a drill chuck) of the motor 114, the attached rod 122, and the brush 120 rotate at about 100 revolutions per minute. In another embodiment, the rotating portion 115 of the motor, the attached rod 122, and the brush 120 may rotate at 10 to 500 revolutions per minute. In still other embodiments, the rotating portion 115 of the motor 114, the attached rod 122, and the brush 120 may rotate at varying speeds. The trigger 118 may comprise a valve or another type of triggering device for generating vacuum suction within the opening 108 of the member 106 and powering on the motor 114. The motor 114 assists in the generation of vacuum suction within the opening 108 of the member 106. In still other embodiments, as described below in the discussion of FIGS. 3 and 4, other external vacuum devices external to the hole cleaning apparatus 100 may act as the vacuum source providing the vacuum suction within the opening 108 of the member 106.

When the trigger 118 is moved to the on-position, the rotating brush 120 rotates around the longitudinal axis 130 of the member 106 to disrupt particles 104 from the hole 102. The particles 104 are vacuum suctioned through the opening 108 of the member 106 due to the vacuum generated by the primary and secondary vacuum generator orifices 107 and 109, and are deposited in bag 128 disposed and attached at the second opposed end 134 of the member 106. The bag 128 is remove-ably attached to the member 106. The user may remove the bag 128 from the member 106 to empty the particles 104 from the bag 128, and may then reattach the bag 128 to the member 106. In other embodiments, the motor 114 may translate the rod 122 and the attached brush 120 back and forth in a direction substantially parallel to the longitudinal axis 130 of the member 106 to disrupt particles 104 from the hole 102. In still other embodiments, the motor 114 may move the rod 122 and the attached brush 120 in any direction (i.e. other than rotating around or translating along the longitudinal axis 130 of the member 106) to disrupt particles 104 from the hole 102.

Figure 3:
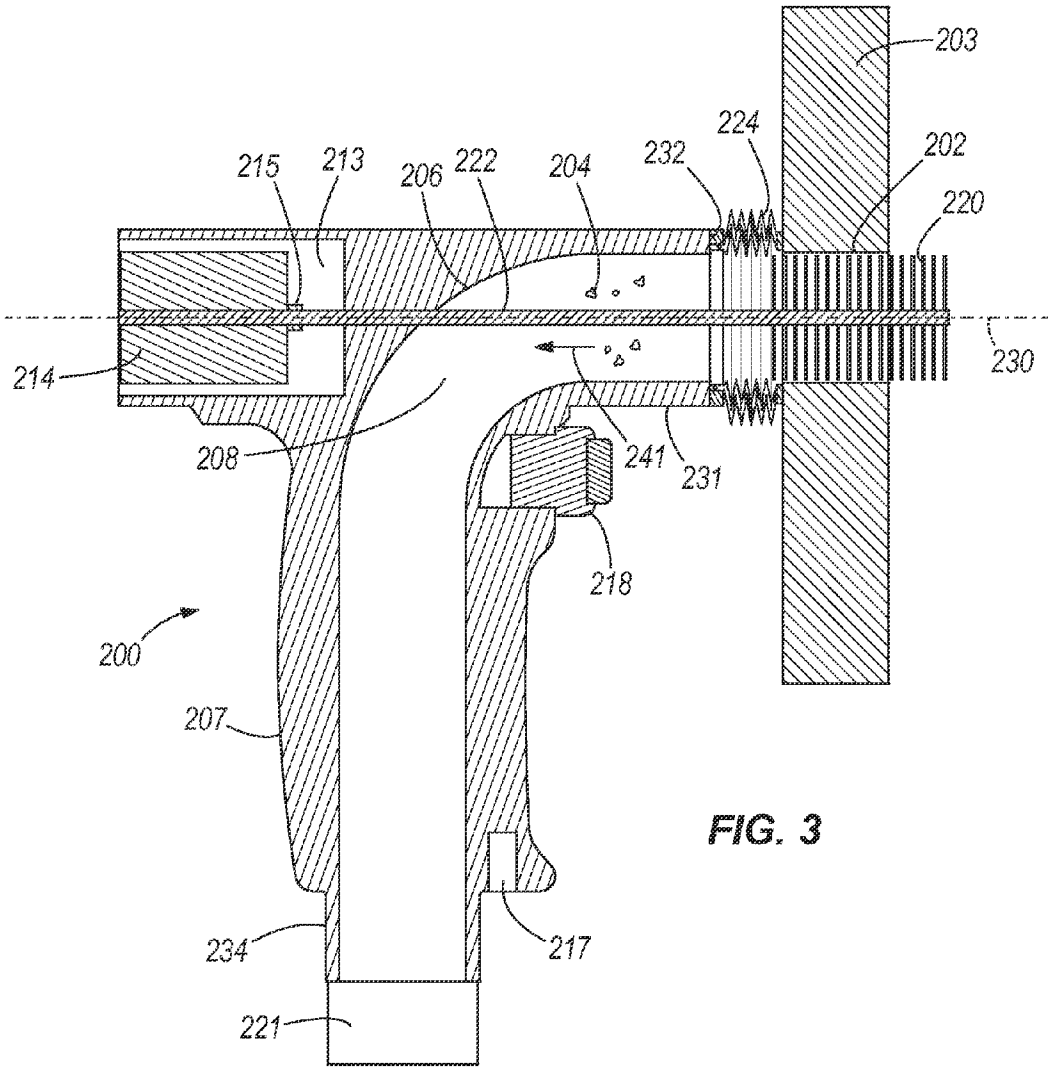
FIG. 3 illustrates a cross-section view of another embodiment of a hand-held hole cleaning apparatus with a brush extended from the hand-held hole cleaning apparatus into a hole of the surface.

FIG. 3 illustrates a cross-section view of another embodiment of a hand-held hole cleaning apparatus 200 with a brush 220 extended from the hand-held hole cleaning apparatus 200 into a hole 202 of the surface 203. The hand-held hole cleaning apparatus 200 may be used to clean the hole 202 of the surface 203 by removing particles 204 from the hole 202. The particles 204 may comprise pieces of the surface 203 resulting from drilling of the hole 202. The surface 203 may comprise an aircraft structure or another type of structure. The hole cleaning apparatus 200 comprises: a member 206 having an opening 208; a motor 214; an electrical supply plug 217; a trigger 218; a brush 220; a rod 222; and a bellowing member 224.

The member 206 and the opening 208 within the member 206 are curved. The member 206 may comprise a tube. In other embodiments, the member 206 may comprise a varying type or shape of member. The member 206 comprises a handle 207. The handle 207 comprises a grip allowing a user to grip the hole cleaning apparatus 200. The brush 220 is moveable relative to the member 206 due to the motor 214 which is connected to the brush 220 with the rod 222. The motor 214 is disposed within an aperture 213 of the cleaning apparatus 200. The motor 214 comprises an electrical motor which may be plugged into an electrical source using the electrical supply plug 217. In another embodiment, a battery may be used to power the motor 214. In still other embodiments, the motor 214 may comprise varying types of motors which may be powered by varying mechanisms. The trigger 218, attached to the handle 212, allows a user to actuate the motor 214 to turn it on and off to rotate the brush 220 and its attached rod 222 which is attached to a rotating portion 215 of the motor 214. The motor 214 may rotate the rotating portions 215 of the motor, the attached rod 222, and the brush 220 at 100 revolutions per minute around a longitudinal axis 230 of the member 206. In other embodiments, the motor 214 may rotate the rotating portions 215 of the motor, the attached rod 222, and the brush 220 in a range of 10 to 500 revolutions per minute. In other embodiments, the motor 214 may rotate the rotating portions 215 of the motor, the attached rod 222, and the brush 220 at varying revolutions per minute. The trigger 118 may comprise a valve or another type of triggering device for powering on the motor 114. The rotating portion 215 of the motor 214 comprises a rotating drill chuck. In other embodiments, the motor 214 may translate the attached rod 222 and the attached brush 220 back and forth in a direction substantially parallel to a longitudinal axis 230 of the member 206. In still other embodiments, the motor 214 may move the attached rod 222 and the attached brush 220 in varying directions.

Figure 4:
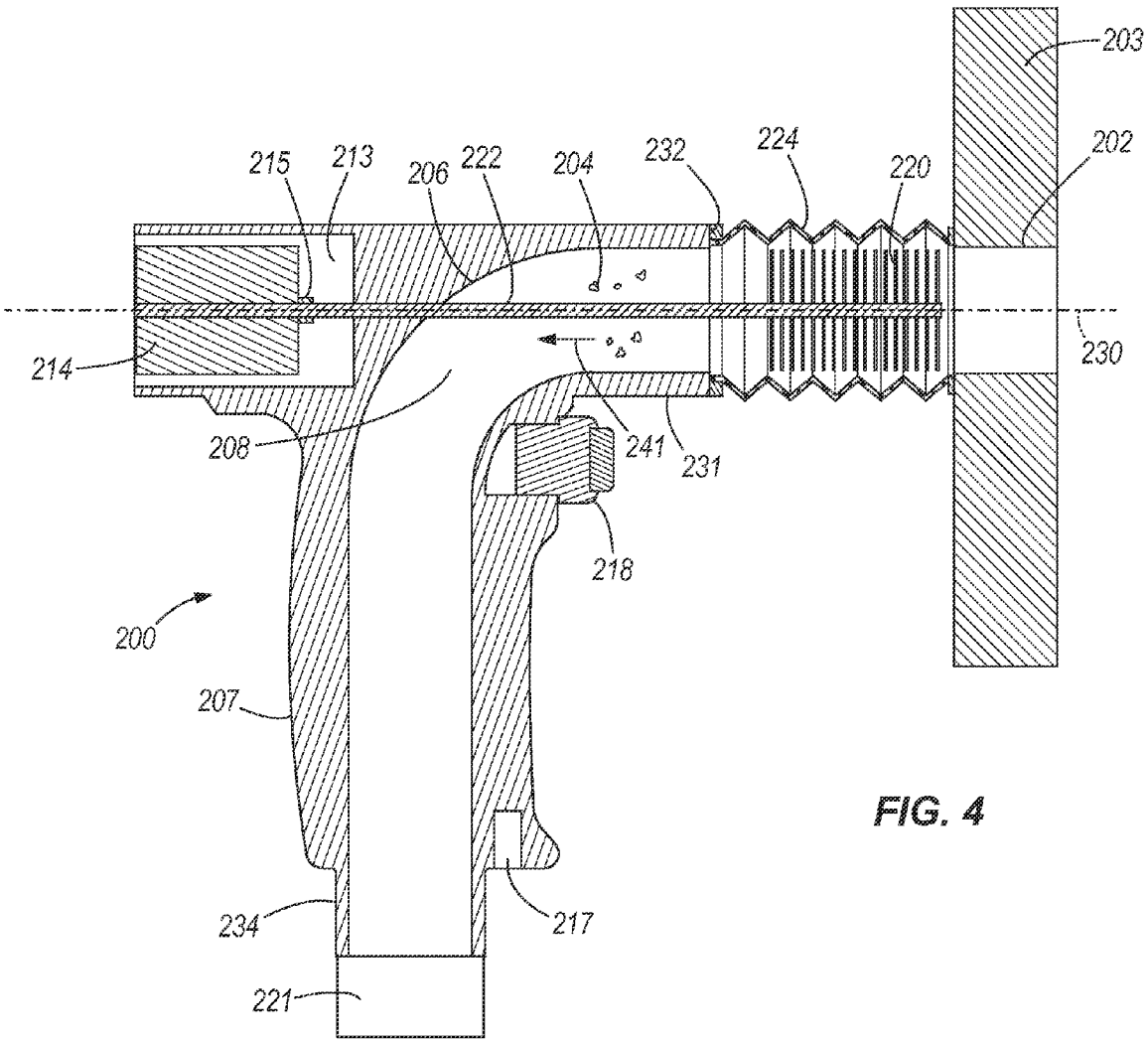
FIG. 4 illustrates a cross-section view of the hand-held hole cleaning apparatus of FIG. 3 with the brush retracted within a bellowing member.

The bellowing member 224 is moveably attached to a first end 232 of the member 206 and is extendable away from and retractable towards the member 206. In other embodiments, the bellowing member 224 may comprise the member 206. The bellowing member 224 is biased away from the member 206 and may comprise a spring-like member. In other embodiments, a separate biasing member may be used to bias the bellowing member 224 away from the member 206. FIG. 4 illustrates a cross-section view of the hand-held hole cleaning apparatus 200 of FIG. 3 with the brush 220 retracted within the bellowing member 224. In use, as shown in FIG. 4, the user uses the handle 207 to abut the bellowing member 224 against or around the hole 202 while the bellowing member 224 is extended away from the member 206 with the brush 220 disposed within the bellowing member 224 outside of the hole 202. As shown in FIG. 3, the user then pushes the handle 207 towards the hole 202 to override the bias of the bellowing member 224 to retract the bellowing member 224 towards the member 206 to push the brush 220 outside of the bellowing member 224 into the hole 202.

An external vacuum device 221 is attached to a second end 234 of the member 206 through a threaded attachment or other attachment mechanism. The external vacuum device 221 may comprise a vacuum or collection device for applying a vacuum suction 241 through the opening 208 of the member 206 to suck the particles 204 out of the hole 202. The external vacuum device 221 supplies 160 inches of H20 of vacuuming suction. In other embodiments, the external vacuum device 221 may supply from 20 inches of H20 to 500 inches of H20 of vacuuming suction. In still other embodiments, the external vacuum device 221 may supply varying amounts of vacuuming suction. When the trigger 218 is moved to the on-position, the rotating brush 220 rotates around a longitudinal axis 230 of a portion 231 of the member 206 to disrupt particles 204 from the hole 202. The particles 204 are vacuum suctioned through the opening 208 of the member 206 and into the external vacuum device 221 due to the vacuum suction supplied by the external vacuum device 221. In other embodiments, the motor 214 may translate the attached rod 222 and the attached brush 220 back and forth substantially parallel to a longitudinal axis 230 of the member 206 to disrupt the particles 204 from the hole 202. In still other embodiments, the motor 214 may move the attached rod 222 and the attached brush 220 in varying directions to disrupt the particles 204 from the hole 202.

Figure 5:
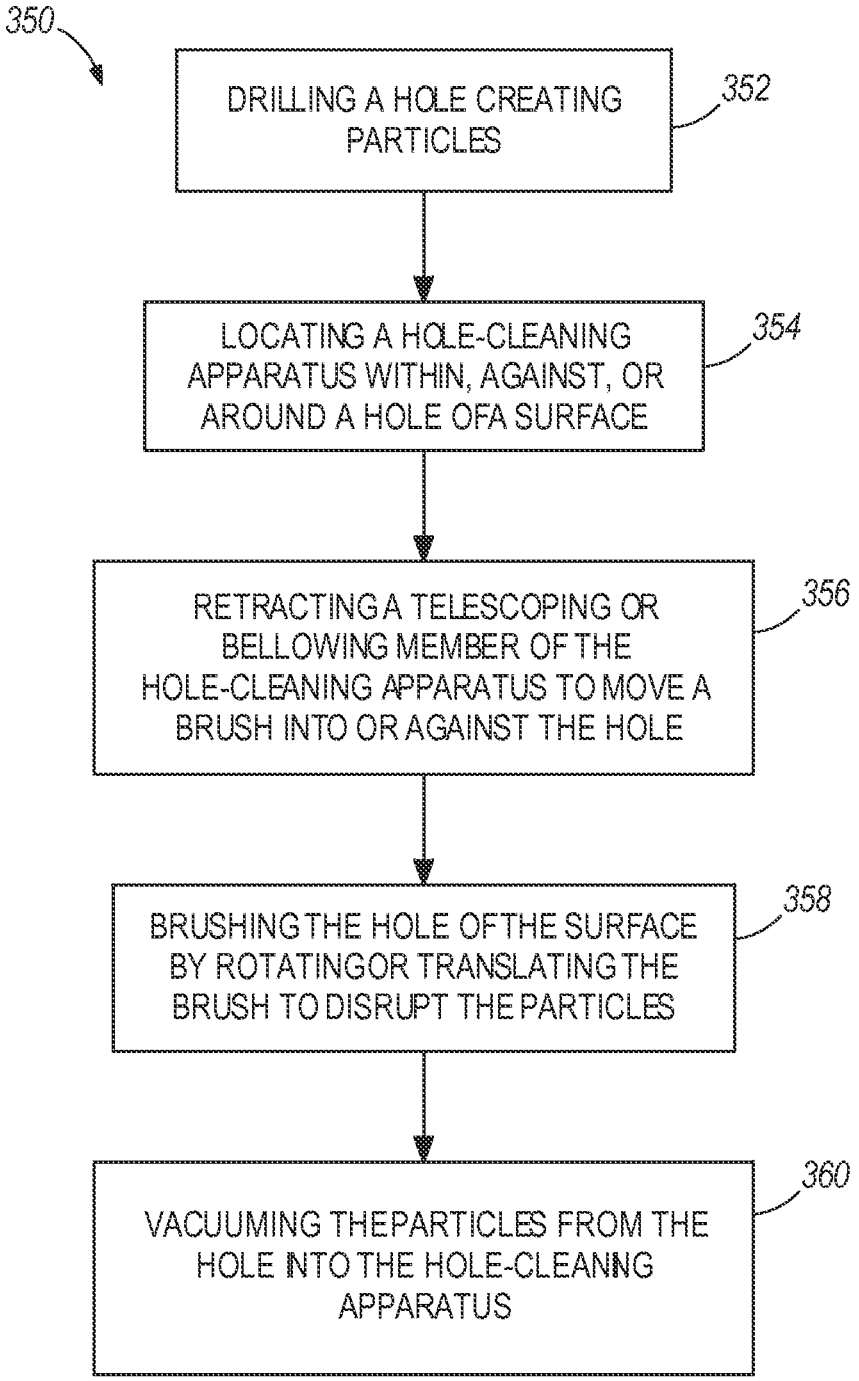
FIG. 5 illustrates a flowchart of one embodiment of a method of cleaning a hole of a surface.

FIG. 5 illustrates a flowchart of one method 350 of cleaning a hole of a surface. In step 352, a hole is drilled in a surface creating particles comprising pieces of the surface resulting from the drilling of the hole. In step 354, a hole cleaning apparatus is located within, against, or around the hole of the surface. The hole cleaning apparatus may comprise any of the embodiments disclosed in this disclosure. In one embodiment, step 354, along with all steps of the method 350, may comprise a user manually holding the hole cleaning apparatus with a handle attached to and extending laterally away from a member of the hole cleaning apparatus. During step 354, a telescoping or bellowing member of the hole cleaning apparatus may be located against or around the hole of the surface while a brush of the hole cleaning apparatus is located within the telescoping or bellowing member. In step 356, the telescoping or bellowing member is retracted towards the member to move the brush within or against the hole of the surface.

In step 358, the hole of the surface is brushed by rotating a brush around or translating the brush in a direction substantially parallel to a longitudinal axis of a member of the hole cleaning apparatus while the brush is located within or against the hole of the surface to disrupt particles of the hole. In one embodiment, step 358 may comprise a motor of the hole cleaning apparatus rotating or translating the brush around or in a direction substantially parallel to the longitudinal axis of the member of the hole cleaning apparatus. In another embodiment, a user may manually rotate or translate the brush around or in a direction substantially parallel to the longitudinal axis of the member of the hole cleaning apparatus. In step 360, the particles are collected from the hole of the surface into the member of the hole cleaning apparatus. In one embodiment, step 360 may comprise vacuuming the particles through the member of the hole cleaning apparatus into a bag of the hole cleaning apparatus using a vacuum suction. In another embodiment, step 360 may comprise vacuuming the particles through the member of the hole cleaning apparatus into an external vacuum device. In an additional embodiment, step 360 may comprise the same motor which is moving the brush acting as the vacuum source to supply the vacuum suction. In another embodiment, step 360 may comprise the motor moving the brush and another device acting as the vacuum source to supply the vacuum suction. In varying embodiments, the steps of the method 350 may occur sequentially, simultaneously, or in any order. In still other embodiments, any of the steps of the method 350 may be altered, not followed, or one or more additional steps may be added.

Figure 6:
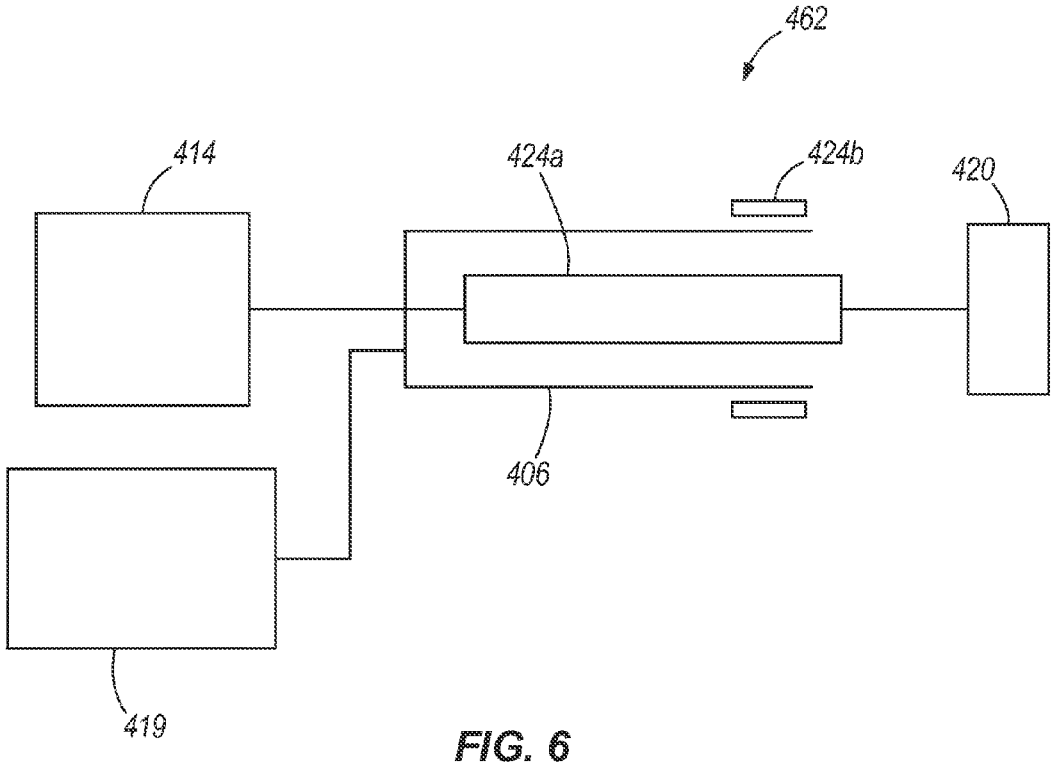
FIG. 6 is a functional block diagram of one embodiment of the disclosure.

FIG. 6 illustrates a generic embodiment of a functional block diagram 462 which covers all of the embodiments of this disclosure. The functional block diagram includes a member 406 (which corresponds to members 106 and 206 of proceeding embodiments), a motor 414 (which corresponds to motors 114 and 214 of proceeding embodiments), a vacuum source comprising at least one of the motor 414 or another external source 419 (which corresponds to external source 119 or external device 221 of proceeding embodiments), a brush 420 (which corresponds to brush 120 and 220 of proceeding embodiments), and a telescoping or bellowing member 424*a* or 424*b* (which corresponds to telescoping or bellow member 124 or 224 of proceeding embodiments). The brush 420 may be moveable relative to member 406. The brush 420 may also be moveable relative to the telescoping or bellowing member 424*a* or 424*b*. The motor 414 may be connected to the brush 420 for rotating or translating the brush. The telescoping or bellowing member 424 may be moveable relative to the member 406. In another embodiment, the member 406 or the brush 420 may comprise the telescoping or bellowing member. At least one of the motor 414 or another external device 419 may be connected to the member 406 for supplying vacuum suction through the member 406.

Figure 7:
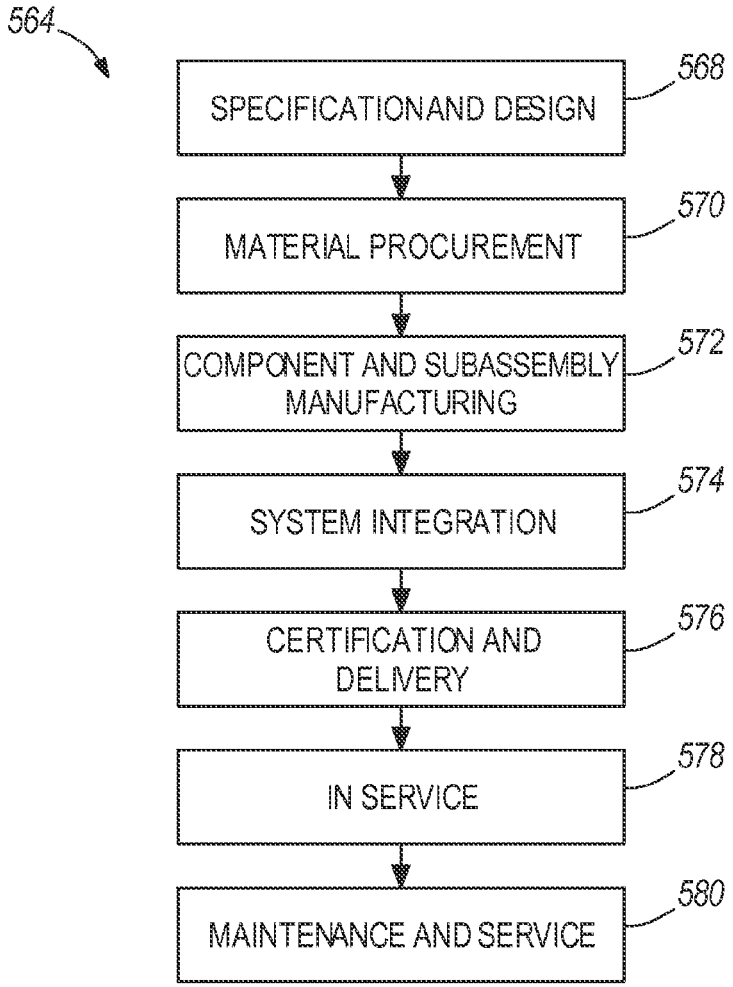
FIG. 7 is a flow diagram of aircraft production and service methodology.
Figure 8:
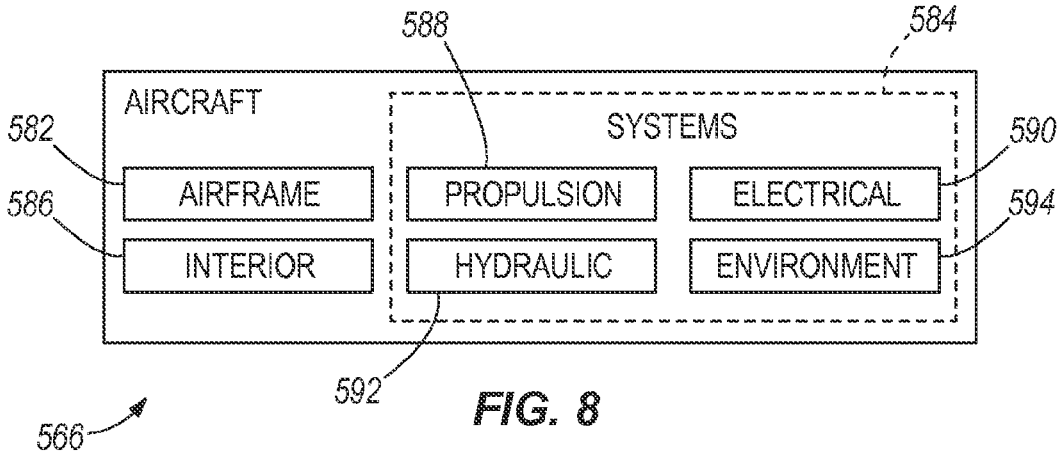
FIG. 8 is a block diagram of an aircraft.

Referring more particularly to the drawings, embodiments of the disclosure may be described in the context of an aircraft manufacturing and service method 564 as shown in FIG. 7 and an aircraft 566 as shown in FIG. 8. During pre-production, exemplary method 564 may include specification and design 568 of the aircraft 566 and material procurement 570. During production, component and subassembly manufacturing 572 and system integration 574 of the aircraft 566 takes place. Thereafter, the aircraft 566 may go through certification and delivery 576 in order to be placed in service 578. While in service by a customer, the aircraft 566 is scheduled for routine maintenance and service 580 (which may also include modification, reconfiguration, refurbishment, and so on).

Each of the processes of method 564 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 8, the aircraft 566 produced by exemplary method 564 may include an airframe 582 with a plurality of systems 584 and an interior 586. Examples of high-level systems 584 include one or more of a propulsion system 588, an electrical system 590, a hydraulic system 592, and an environmental system 594. Any number of other systems may be included. Although an aerospace example is shown, the principles of the invention may be applied to other industries, such as the automotive industry.

Apparatus and methods embodied herein may be employed during any one or more of the stages of the production and service method 564. For example, components or subassemblies corresponding to production process 572 may be fabricated or manufactured in a manner similar to components or subassemblies produced while the aircraft 566 is in service. Also, one or more apparatus embodiments, method embodiments, or a combination thereof may be utilized during the production stages 572 and 574, for example, by substantially expediting assembly of or reducing the cost of an aircraft 566. Similarly, one or more of apparatus embodiments, method embodiments, or a combination thereof may be utilized while the aircraft 566 is in service, for example and without limitation, to maintenance and service 580.

One or more embodiments of the disclosure may effectively, efficiently, timely, and consistently clean a hole of a surface in an ergonomic manner. It should be understood, of course, that the foregoing relates to exemplary embodiments of the disclosure and that modifications may be made without departing from the spirit and scope of the disclosure as set forth in the following claims.

We claim:

1. A hole cleaning apparatus comprising:

a member;

a brush which at least one of rotates around a longitudinal axis of the member or translates in a direction which is substantially parallel to the longitudinal axis of the member; and a vacuum source providing vacuum suction within the member, wherein the vacuum source comprises a motor that exhausts pressurized air to generate the vacuum suction, and wherein the motor is connected to the brush for at least one of rotating or translating the brush.

2. The hole cleaning apparatus of claim 1 wherein the brush is manually operated by a user.

3. The hole cleaning apparatus of claim 1 further comprising at least one of a telescoping member or a bellowing member, being attached to an end of the member extendable away from the member and retractable towards the member.

4. The hole cleaning apparatus of claim 3 further comprising a biasing member biasing at least one of the telescoping member or the bellowing member, away from the member.

5. The hole cleaning apparatus of claim 3 wherein the brush is disposed within at least one of the telescoping member or the bellowing member, when at least one of the telescoping member or the bellowing member, is extended away from the member, and is disposed outside of at least one of the telescoping member or the bellowing member, when at least one of the telescoping member or the bellowing member, is retracted towards the member.

6. The hole cleaning apparatus of claim 1 further comprising at least one airway extending from the vacuum source into the member.

7. The hole cleaning apparatus of claim 1 further comprising a handle attached to and extending laterally from the member.

8. The hole cleaning apparatus of claim 1 wherein the member comprises an opening extending within the member along the longitudinal axis, and first and second opposed ends, the brush is disposed at the first opposed end of the member, a bag is disposed at the second opposed end of the member, and the opening has a varying sized cross-section to facilitate generation of the vacuum suction.

9. A hole cleaning apparatus comprising:

a member;

a brush;

at least one of a telescoping member or a bellowing member, which is extendable and retractable; and a vacuum source providing vacuum suction within the member, wherein the vacuum source comprises a motor that exhausts pressurized air to generate the vacuum suction, and wherein the motor is connected to the brush for at least one of rotating and translating the brush.

10. The hole cleaning apparatus of claim 9 wherein the brush is manually operated by a user.

11. The hole cleaning apparatus of claim 9 further comprising a biasing member biasing at least one of the telescoping member or the bellowing member.

12. The hole cleaning apparatus of claim 9 wherein the member comprises an opening extending within the member, and first and second opposed ends, the brush is disposed at the first opposed end of the member, a bag is disposed at the second opposed end of the member, and the opening has a varying sized cross-section to facilitate generation of the vacuum suction.

13. A hole cleaning apparatus comprising:

a member;

a brush which at least one of rotates around a longitudinal axis of the member or translates in a direction which is substantially parallel to the longitudinal axis of the member; and a vacuum source providing vacuum suction within the member, wherein the vacuum source comprises a motor that exhausts pressurized air to generate the vacuum suction, and wherein the motor is connected to the brush for at least one of rotating and translating the brush, wherein the member comprises an opening extending within the member along the longitudinal axis, and first and second opposed ends, the brush is disposed at the first opposed end of the member, a bag is disposed at the second opposed end of the member, and the opening has a varying sized cross-section to facilitate generation of the vacuum suction.

14. The hole cleaning apparatus of claim 1, wherein the member comprises a first plurality of vacuum generator orifices;

the motor comprises an exhaust port, operable to exhaust air from the motor; and the member further comprises a motor exhaust airway, arranged to direct exhausted air to the first plurality of vacuum generator orifices.

15. The hole cleaning apparatus of claim 14, wherein:

the member further comprises a second plurality of vacuum generator orifices; and the hole cleaning apparatus further comprises:

a trigger that is selectively movable to an on position;

a supply airway, arranged to direct pressurized air to the trigger, wherein the supply airway is in communication with the trigger and the motor operates on compressed air;

a motor supply airway arranged to direct pressurized air from the trigger to the motor when the trigger is moved to the on position; and a primary vacuum generator supply airway arranged to direct air from the trigger to the second plurality of vacuum generator orifices when the trigger is moved to the on position, wherein the motor exhaust airway directs exhausted pressurized air from the motor to the first plurality of vacuum generator orifices when the trigger is moved to the on position.

16. The hole cleaning apparatus of claim 9, wherein the member comprises a first plurality of vacuum generator orifices;

the motor comprises an exhaust port, operable to exhaust air from the motor; and the member further comprises a motor exhaust airway, arranged to direct exhausted air to the first plurality of vacuum generator orifices.

17. The hole cleaning apparatus of claim 16, wherein:

the member further comprises a second plurality of vacuum generator orifices; and the hole cleaning apparatus further comprises:

a trigger that is selectively movable to an on position;

a supply airway, arranged to direct pressurized air to the trigger, wherein the supply airway is in communication with the trigger and the motor operates on compressed air;

a motor supply airway arranged to direct pressurized air from the trigger to the motor when the trigger is moved to the on position; and a primary vacuum generator supply airway arranged to direct air from the trigger to the second plurality of vacuum generator orifices when the trigger is moved to the on position, wherein the motor exhaust airway directs exhausted pressurized air from the motor to the first plurality of vacuum generator orifices when the trigger is moved to the on position.

18. The hole cleaning apparatus of claim 13, wherein the member comprises a first plurality of vacuum generator orifices;

the motor comprises an exhaust port, operable to exhaust air from the motor; and the member further comprises a motor exhaust airway, arranged to direct exhausted air to the first plurality of vacuum generator orifices.

19. The hole cleaning apparatus of claim 18, wherein:

the member further comprises a second plurality of vacuum generator orifices; and the hole cleaning apparatus further comprises:

a trigger that is selectively movable to an on position;

a supply airway, arranged to direct pressurized air to the trigger, wherein the supply airway is in communication with the trigger and the motor operates on compressed air;

a motor supply airway arranged to direct pressurized air from the trigger to the motor when the trigger is moved to the on position; and a primary vacuum generator supply airway arranged to direct air from the trigger to the second plurality of vacuum generator orifices when the trigger is moved to the on position, wherein the motor exhaust airway directs exhausted pressurized air from the motor to the first plurality of vacuum generator orifices when the trigger is moved to the on position.

* * * * *